US006390938B1

(12) United States Patent
Asakura et al.

(10) Patent No.: US 6,390,938 B1
(45) Date of Patent: May 21, 2002

(54) GOLF BALL

(75) Inventors: Takeshi Asakura, Akashi; Kaname Yamada, Kakogawa, both of (JP)

(73) Assignee: Sumitomo Rubber Industries, Ltd., Hyogo-Ken (JP)

( * ) Notice: Subject to any disclaimer, the term of this patent is extended or adjusted under 35 U.S.C. 154(b) by 0 days.

(21) Appl. No.: 09/568,807

(22) Filed: May 11, 2000

(30) Foreign Application Priority Data

Jun. 1, 1999 (JP) ..... 11-154090

(51) Int. Cl.[7] ..... A63B 37/12
(52) U.S. Cl. ..... 473/378
(58) Field of Search ..... 473/378–384

(56) References Cited

U.S. PATENT DOCUMENTS

| | | | | |
|---|---|---|---|---|
| 4,772,026 A | | 9/1988 | Gobush | |
| 4,946,167 A | * | 8/1990 | Yamada | 473/378 |
| 4,948,143 A | * | 8/1990 | Aoyama | 473/378 |
| 5,078,402 A | * | 1/1992 | Oka | 473/378 |
| 5,087,049 A | | 2/1992 | Yamagishi et al. | |
| 5,143,377 A | | 9/1992 | Oka et al. | |
| 5,156,404 A | * | 10/1992 | Oka et al. | 473/378 |
| 5,415,410 A | * | 5/1995 | Aoyama | 473/382 |
| 5,544,889 A | * | 8/1996 | Moon | 473/383 |

FOREIGN PATENT DOCUMENTS

| | | |
|---|---|---|
| GB | 2157959 A | 11/1985 |
| GB | 0234081 A | 9/1987 |
| GB | 2235879 A | 3/1991 |
| GB | 2242836 A | 10/1991 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

A golf ball has a spherical surface provided with a plurality of dimples, a parting line extending on a great circle without crossing any of the dimples, and a first great circle, a second great circle and a third great circle dividing the spherical surface into eight spherical equilateral triangles, wherein the parting line crosses six of the eight spherical equilateral triangles, and with respect to each of the first to third great circles, the number of dimples on one side of the great circle is equal to the number of dimples on the other side of the great circle. Further, the golf ball may have the following features: with respect to any of two opposite equilateral triangles which are opposed about the center point of the spherical surface, the arrangement of dimples in one of them and the arrangement of dimples in the other are point-symmetrical about the center point; with respect to any of two adjacent spherical equilateral triangles which have a side in common, the arrangement of dimples in one of them and the arrangement of dimples in the other are not line-symmetrical about the common side; and with respect to any of four adjacent spherical equilateral triangles which have an apex in common, the arrangement of dimples in the four spherical equilateral triangles is not a point-symmetry about the common apex.

8 Claims, 15 Drawing Sheets

: First dimples
: Second dimples
: Third dimples
: Fourth dimples

Fig.11A
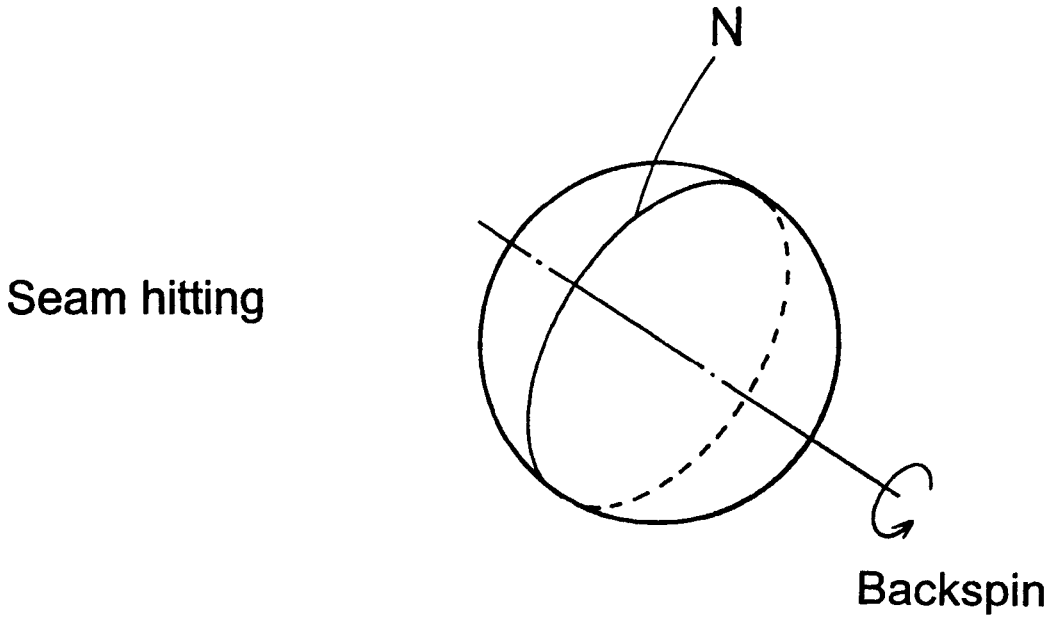
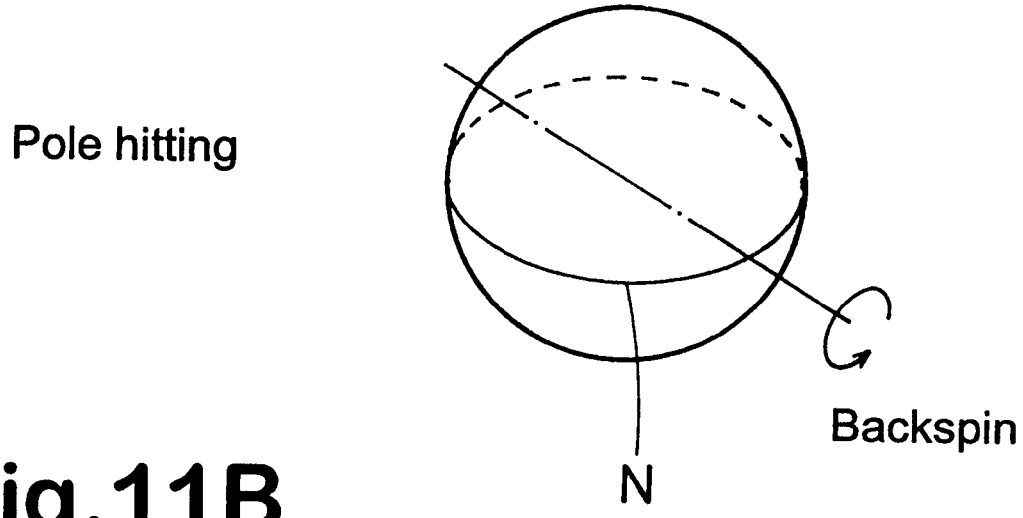
Fig.11B

GOLF BALL

BACKGROUND OF THE INVENTION

The present invention relates to a golf ball, more particularly to an improved dimple arrangement being capable of improving the aerodynamic symmetry.

The golf balls are provided with dimples on the spherical surface thereof. The dimples can promote eddy flow of the air during flying, which improve air resistance. Further, when backspin is given to the golf ball, the transition point from laminer air flow to eddy flow is differed between the upside and downside of the golf ball, and the dimples can increase the positional difference thereof, which improve lift.

Thus, it can be said that dimples are aerodynamically better if the laminer air flow along the golf ball surface is more disturbed thereby, and that wherever the rotational axis of backspin occurs on the golf ball, flight characteristics such as ballistic course height, flight duration, flying distance and the like should be invariable.

On the other hand, the golf balls are usually made with a mold, and it is difficult to form dimples on the mold parting line. Therefore, a golf ball has generally at least one parting line (corresponding to the mold parting line) on which dimples are not arranged.

If a backspin is given as shown in FIG. 11A wherein the circumferential speed of the golf ball is maximum along the parting line N (hereinafter such a hitting is called "seam hitting"), as the dimples are not arranged on the parting line N and thus the dimples effect is less, the ballistic course height and flying distance becomes decreased in comparison with a case of FIG. 11B wherein the rotational axis of backspin is on a plane including the parting line N (hereinafter such a hitting is called "pole hitting").

SUMMARY OF THE INVENTION

It is therefore, an object of the present invention to provide a golf ball of which aerodynamic symmetry is improved to decrease flight characteristic variations depending on hitting position.

According to the present invention, a golf ball has a spherical surface provided with a plurality of dimples, a parting line extending on a great circle without crossing any of the dimples, and a first great circle, a second great circle and a third great circle dividing the spherical surface into eight spherical equilateral triangles, wherein the parting line crosses six of the eight spherical equilateral triangles, and with respect to each of the first to third great circles, the number of dimples on one side of the great circle is equal to the number of dimples on the other side of the great circle.

BRIEF DESCRIPTION OF THE DRAWINGS

An embodiment of the present invention will now be described in detail in conjunction with the accompanying drawings.

FIG. 11A is a diagrammatic perspective view for explaining seam hitting.

FIG. 11B is a diagrammatic perspective view for explaining pole hitting.

DETAILED DESCRIPTION OF THE PREFERRED EMBODIMENTS

Figure 1:
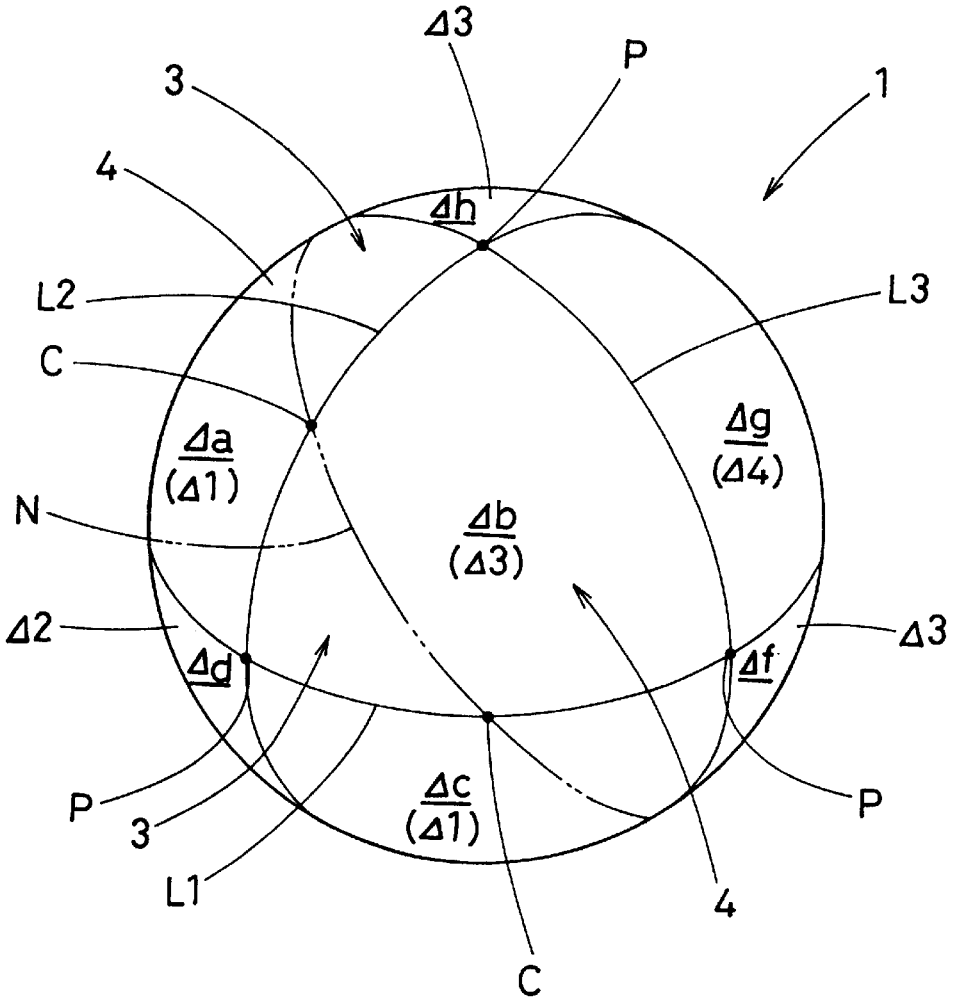
FIG. 1 is a diagrammatic perspective view showing a parting line and three great circles of a golf ball according to the present invention.

In the figures, a golf ball 1 according to the present invention has a spherical surface provided with dimples 2, and a parting line N, a first great circle L1, a second great circle L2 and a third great circle L3.

The second great circle L2 and third great circle L3 intersect the first great circle L1 at an intersecting angle of 90 degrees to quadrisect the circumferential length of the first great circle L1. Accordingly, the spherical surface is divided into eight spherical equilateral triangles Δa, Δb, Δc, Δd, Δe, Δf, Δg, Δh of which the apexes are the intersecting points P between the great circles L1, L2, L3 and all the sides between the apexes P have one length of ¼ of the circumferential length of a great circle.

The golf ball 1 has only one parting line N in order to minimize the reduction of dimple effect. The parting line N extends along another great circle without crossing any of the dimples 2. The parting line N crosses six of the eight spherical equilateral triangles. The six spherical equilateral triangles are Δa, Δb, Δc, Δf, Δe and Δh.

In this embodiment, the parting line N intersects two of the three sides of each triangle at the midpoint C of each of the two sides, whereby each of the six spherical equilateral triangles is subdivided into a spherical isosceles triangle 3 and a spherical quadrangle 4. The angles γ of the parting line N and the sides of six of the spherical equilateral triangle Δ are 45 degrees.

In case where the parting line N does not pass through the midpoints C of the sides, it is preferable that the intersecting angle γ is set in the range of not less than 25 degrees, more preferably not less than 40 degrees but less than 45 degrees for the aerodynamic symmetry.

The dimples 2 have at least two diameters, preferably more than two diameters, more preferably more than three diameters. In this embodiment, the dimples 2 include four kinds of dimples having different diameters: a first dimple 2A, second dimple 2B, third dimple 2C and fourth dimple 2D, the diameters thereof are 2A>2B>2C>2D.

With respect to every plane including one of the first to third great circles L1, L2 and L3, the number of dimples on one side of the plane is the same as the number of dimples on the other side of the plane.

Preferably, in each kind of dimples 2A–2D, with respect to every plane including one of three great circles L1, L2 and L3 and further the parting line N, the number of dimples on one side of the plane is the same as the number of dimples on the other side.

The total number of all the dimples 2 is preferably set in the range of from 280 to 540, more preferably 360 to 440.

In this embodiment, the dimples 2 are round, but it is also possible to use non-circular dimples, e.g. rounded square, polygon and the like, instead of the round dimples 2 or some of them. The three-dimensional shape of each dimple 2 is a part of a sphere, but various curved surfaces can be used.

Figure 2:
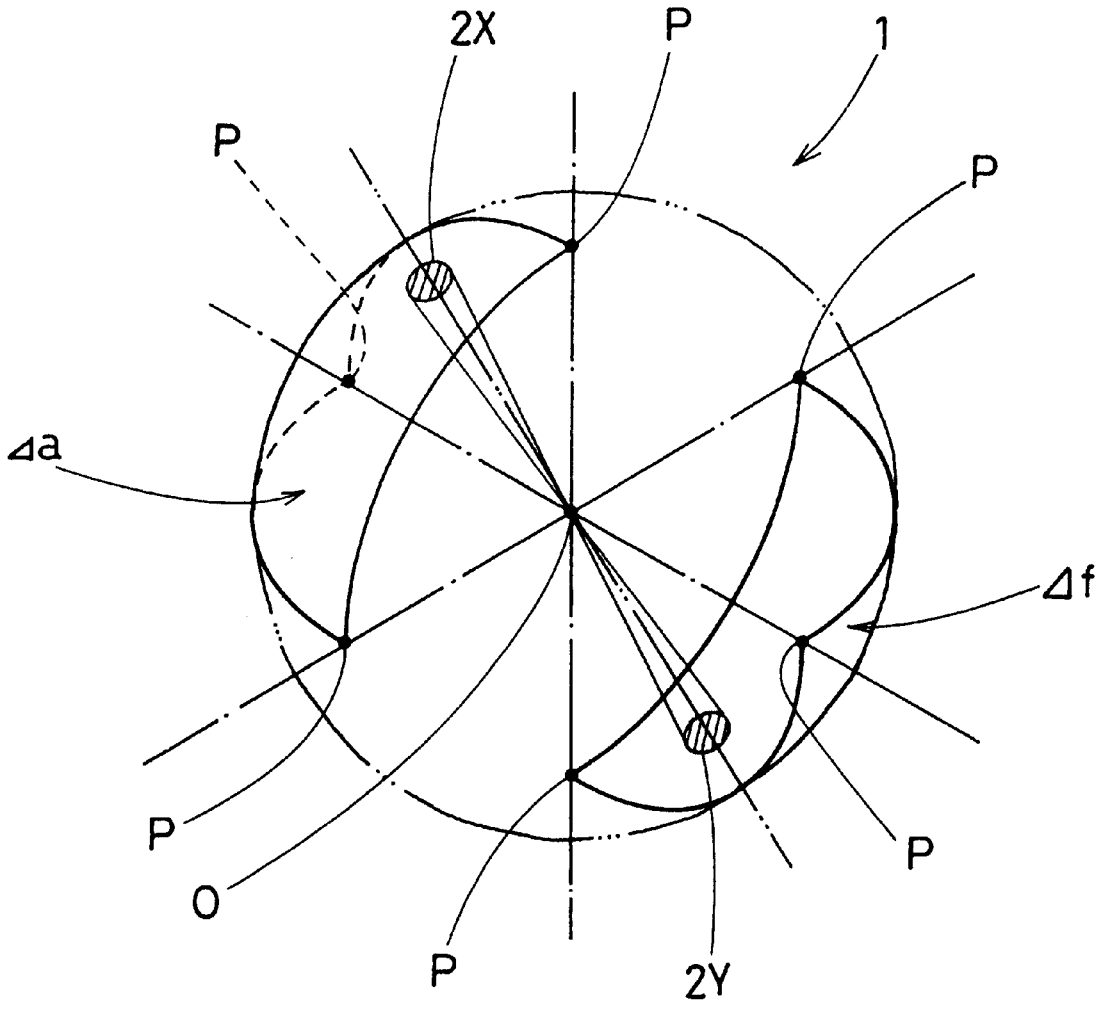
FIG. 2 is a diagrammatic perspective view for explaining a point symmetry about the center point of the spherical surface of the golf ball.

With respect to any two opposite spherical equilateral triangles (Δa&Δf), (Δb&Δe), (Δc&Δh), (Δd&Δg) which are opposed about the center point O of the spherical surface, the arrangement of dimples in one of them and that in the other are point-symmetrical about the center point O. In other words, in case of (Δa&Δf) for example, as shown in FIG. 2, every dimple 2X in the spherical equilateral triangle Δa has the same kind of dimple 2Y at the point-symmetrical position in the spherical equilateral triangle Δf. This is also satisfied on the remaining triangle combinations (Δb&Δe), (Δc&Δh) and (Δd&Δg). In this embodiment, as the parting line N passes through the midpoints C of the sides of the spherical equilateral triangles, any two opposite spherical isosceles triangles 3 have dimple arrangements point-symmetric about the center point O, and also any two opposite spherical quadrangles 4 have dimple arrangements point-symmetric about the center point O.

Figure 3A:
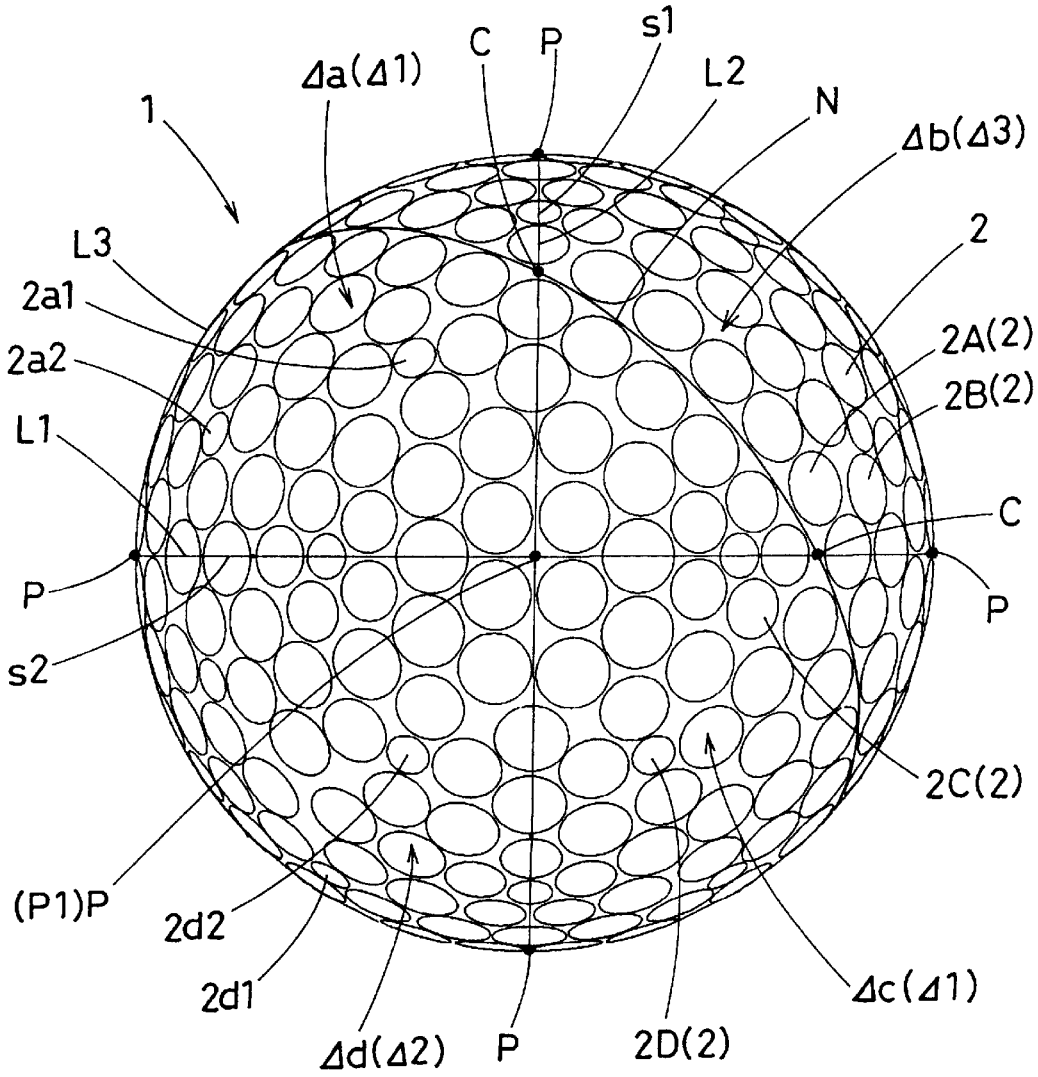
FIG. 3A is a front view of an embodiment of the present invention.
Figure 3B:
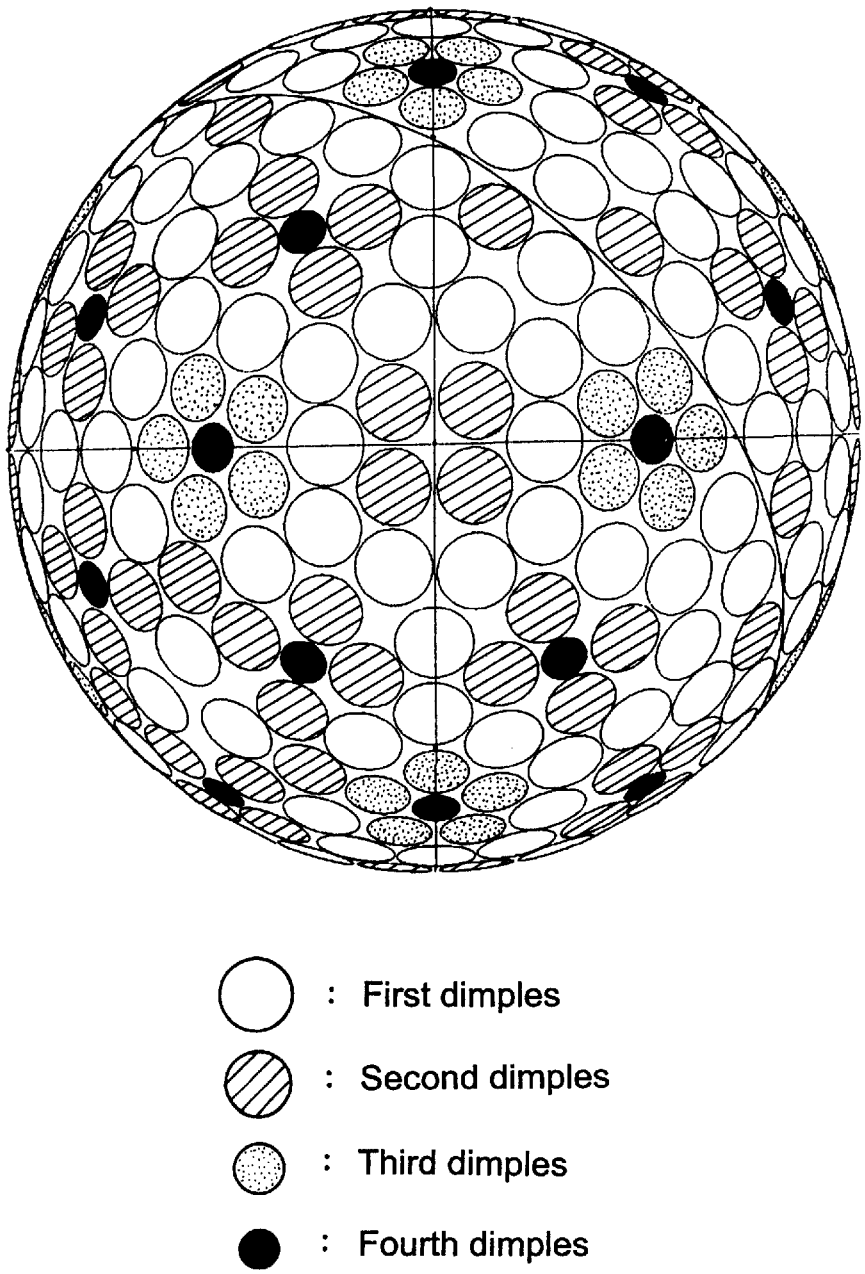
FIG. 3B is the front view wherein the dimples having different diameters are distinguished by using different colors.
Figure 4:
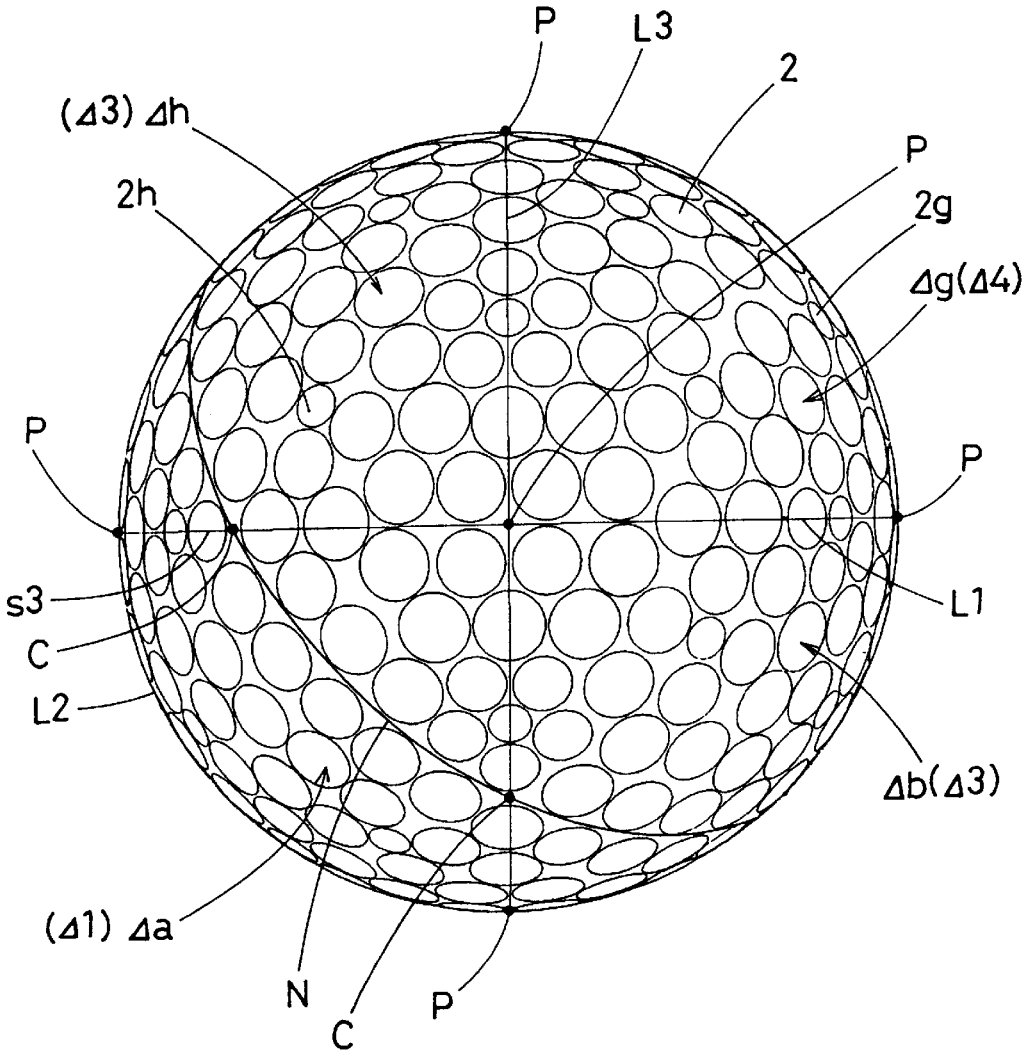
FIG. 4 is a top view thereof.
Figure 5:
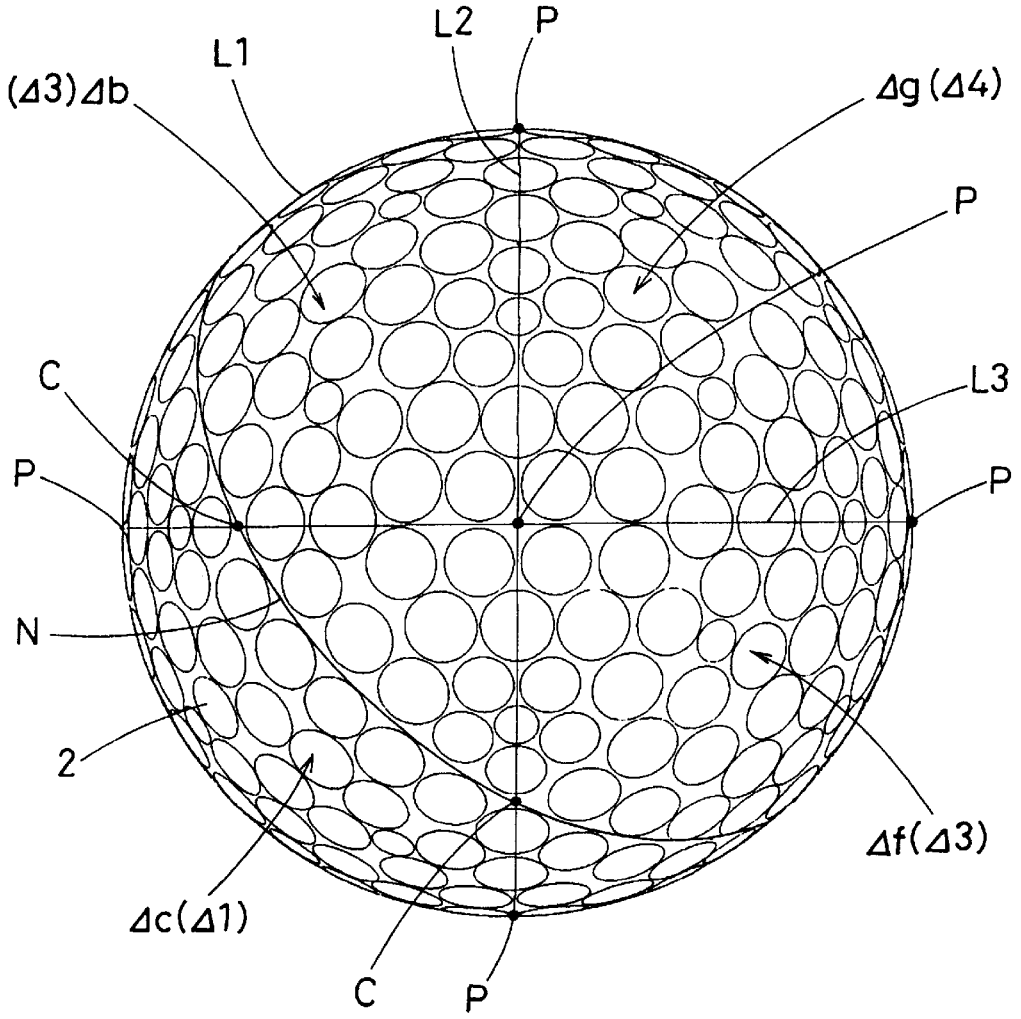
FIG. 5 is a right view thereof.

With respect to any two adjacent spherical equilateral triangles (Δa&Δb), (Δa&Δd), (Δa&Δh), (Δb&Δc), (Δb&Δg), (Δc&Δd), (Δc&Δf), (Δd&Δe), (Δe&Δf), (Δe&Δh), (Δf&Δg), (Δg&Δh) which have a side in common, the arrangement of dimples in one of them and that in the other are not line-symmetrical about the common side. In this embodiment, this line-asymmetry is mainly provided by forming one or more (but small number on dimples in one of the two adjacent spherical equilateral triangles. Nevertheless, it is also possible to form one or more (but small number of) dimples in the other spherical equilateral triangle as far as they are not line-symmetrical. For example, as shown in FIG. 3A and 3B, in case of (Δa&Δb), the common side is s1, and a dimple 2*a*1 is disposed in Δa not Δb. In case of (Δa&Δd), the common side is s2, and a dimple 2*d*1 is disposed in Δd not Δa. As shown in FIG. 4, in case of (Δa&Δh), the common side is s3, and a dimple 2*h* is disposed in Δh not Δa. Also, in the remainder, the asymmetry is provided in the same way. In this embodiment, if the added one or more dimples are not taken into consideration, the dimple arrangements are almost line-symmetrical about the common side.

With respect to any four spherical equilateral triangles (Δa,Δb,Δc,Δd), (Δa,Δh,Δg,Δb), (Δb,Δg,Δf,Δc), (Δa,Δd,Δe, Δh), (Δc,Δf,Δe,Δd), (Δe,Δf,Δg,Δh) which have an apex P in common, the arrangement of dimples in the four spherical equilateral triangles as a whole, namely in a hemisphere is not a point-symmetry about the common apex P. To be exact, when the dimples in the four spherical equilateral triangles or a hemisphere are projected on a plane normal to an axis passing the common apex P and the center point O as shown in FIGS. 3 to 8, the arrangement of the dimples is not a point-symmetry about the common apex P. This point-asymmetry can be provided such that one or more dimples are disposed point-asymmetrically but the remaining dimples are disposed point-symmetrically. For example, in FIG. 3A, four spherical equilateral triangles Δa, Δb, Δc and Δd has an apex P1 in common. The dimple arrangements of the opposed spherical equilateral triangles Δa and Δc are rendered point-asymmetrical mainly for the existence of a dimple 2*a*2 disposed in only Δa. The dimple arrangements of the opposed spherical equilateral triangles Δb and Δd are rendered point-asymmetrical mainly for the existence of a dimple 2*d*2 disposed in only Δd. In the remaining four-triangle combinations, a point-asymmetry is provided in the same way. Further, in this embodiment, the dimple arrangement of the four spherical equilateral triangles is not a rotation-symmetry about the common apex P.

In this embodiment, the eight spherical equilateral triangles Δa–Δh have dimple patterns Δ1–Δ4 as follows:

three spherical equilateral triangles Δa,Δc,Δe (first spherical equilateral triangle) have a first dimple pattern Δ1, wherein any two first spherical equilateral triangles are not located point-symmetrically about the center point O;

one spherical equilateral triangle Δd (second spherical equilateral triangle) has a second dimple pattern Δ2, wherein this second spherical equilateral triangle and any one of first spherical equilateral triangles are not located point-symmetrically about the center point O;

three spherical equilateral triangles Δf,Δh,Δb (third spherical equilateral triangle) have a third dimple pattern Δ3, wherein third spherical equilateral triangles Δf,Δh,Δb are located point-symmetrically with respect to the first spherical equilateral triangles Δa,Δc,Δe, respectively about the center point O; and one spherical equilateral triangle Δg (fourth spherical equilateral triangle) has a fourth dimple pattern Δ4, wherein the fourth and second spherical equilateral triangles are located point-symmetrically about the center point O. The first dimple pattern Δ1 and the second dimple pattern Δ2 are different from each other. The first dimple pattern Δ1 and the third dimple pattern Δ3 are in a relation of a point-symmetry about the center point O, and the second dimple pattern Δ2 and the fourth dimple pattern Δ4 are in a relation of a point-symmetry about the center point O. The second and fourth dimple patterns Δ2 and Δ4 are not crossed by the parting line N, and, roughly speaking, they are formed by adding a smaller dimple to the first and third dimple patterns Δ1 and Δ3, respectively and the positions of the added smaller dimples correspond to a position on the parting line N.

Further, in this embodiment, the first to third great circles L1, L2 and L3 cross some of the dimples, but the number of the crossed dimples is reduced. Furthermore, no dimple is disposed at the six apexes P at which two of the first to third great circles L1 to L3 intersect. In general, dimples are arranged so as to be crossed by the great circles L1 to L3. However, by appropriately forming land area being void of dimples rather than compactly arranging dimples, it becomes possible to randomize the dimple arrangement freely so as to be able to more disturb the laminar airflow along the golf ball's surface.

Figure 6:
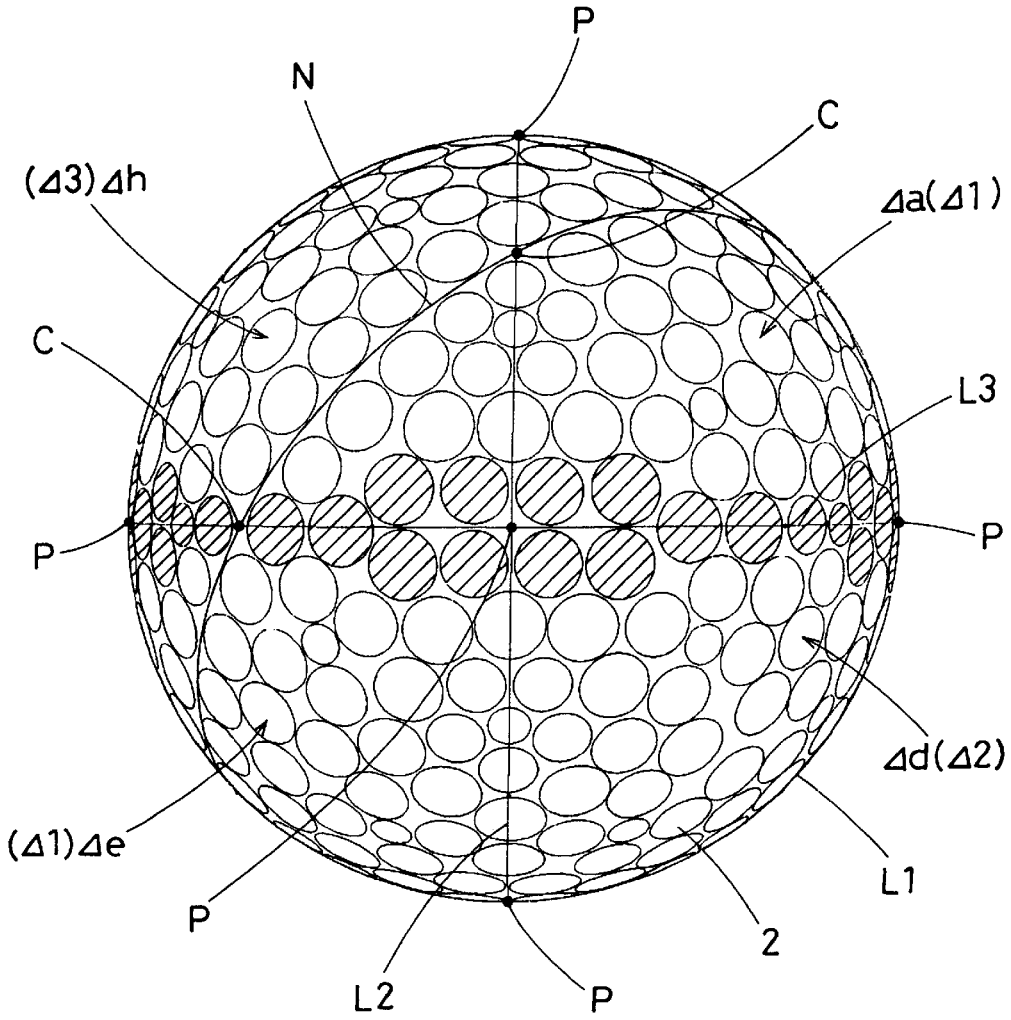
FIG. 6 is a left view thereof wherein dimples crossed by one great circle and dimples adjacent thereto are distinguished by using a dark color.
Figure 7:
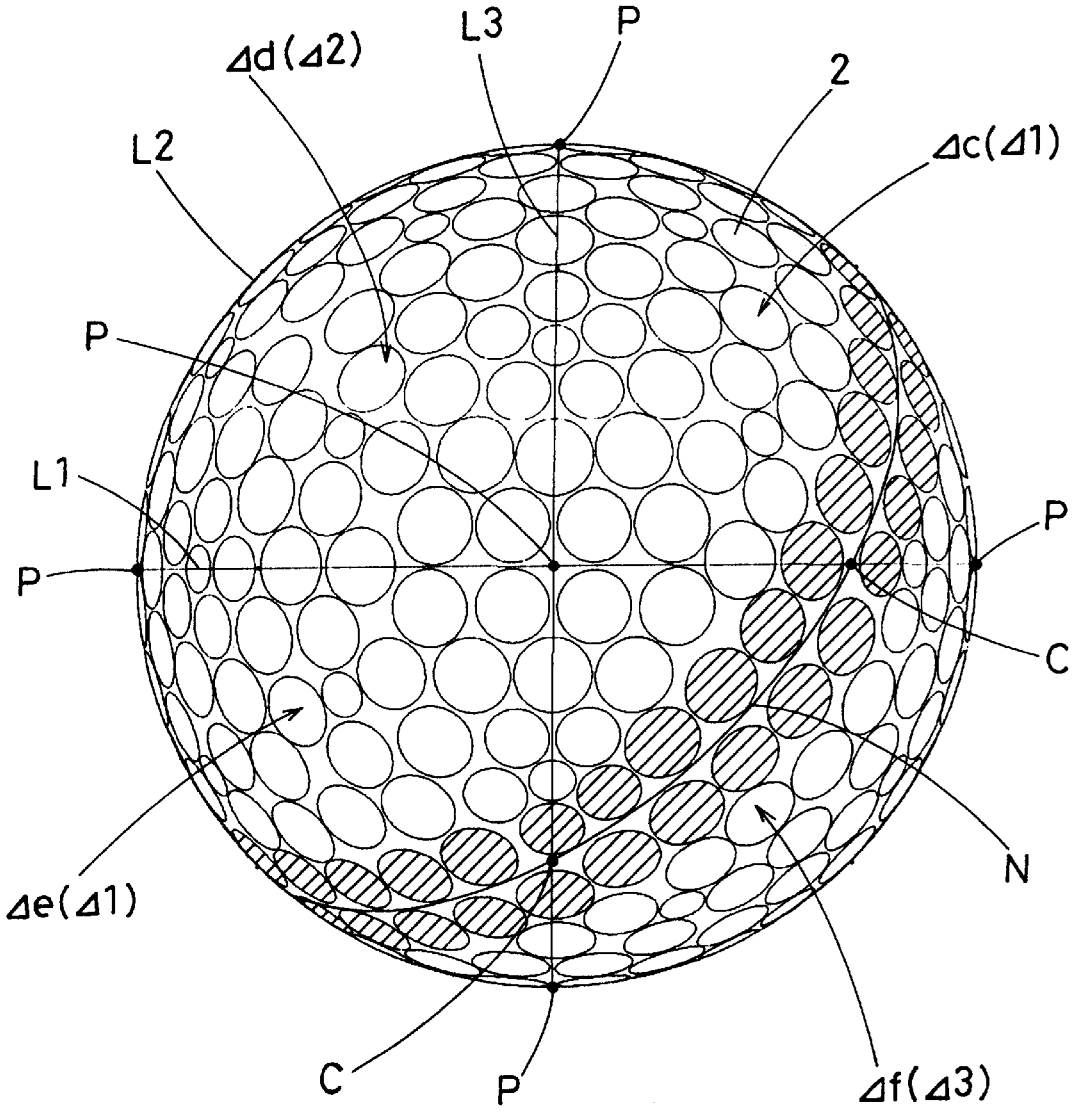
FIG. 7 is a bottom view thereof wherein dimples adjacent to the parting line are distinguished by using a dark color.
Figure 8:
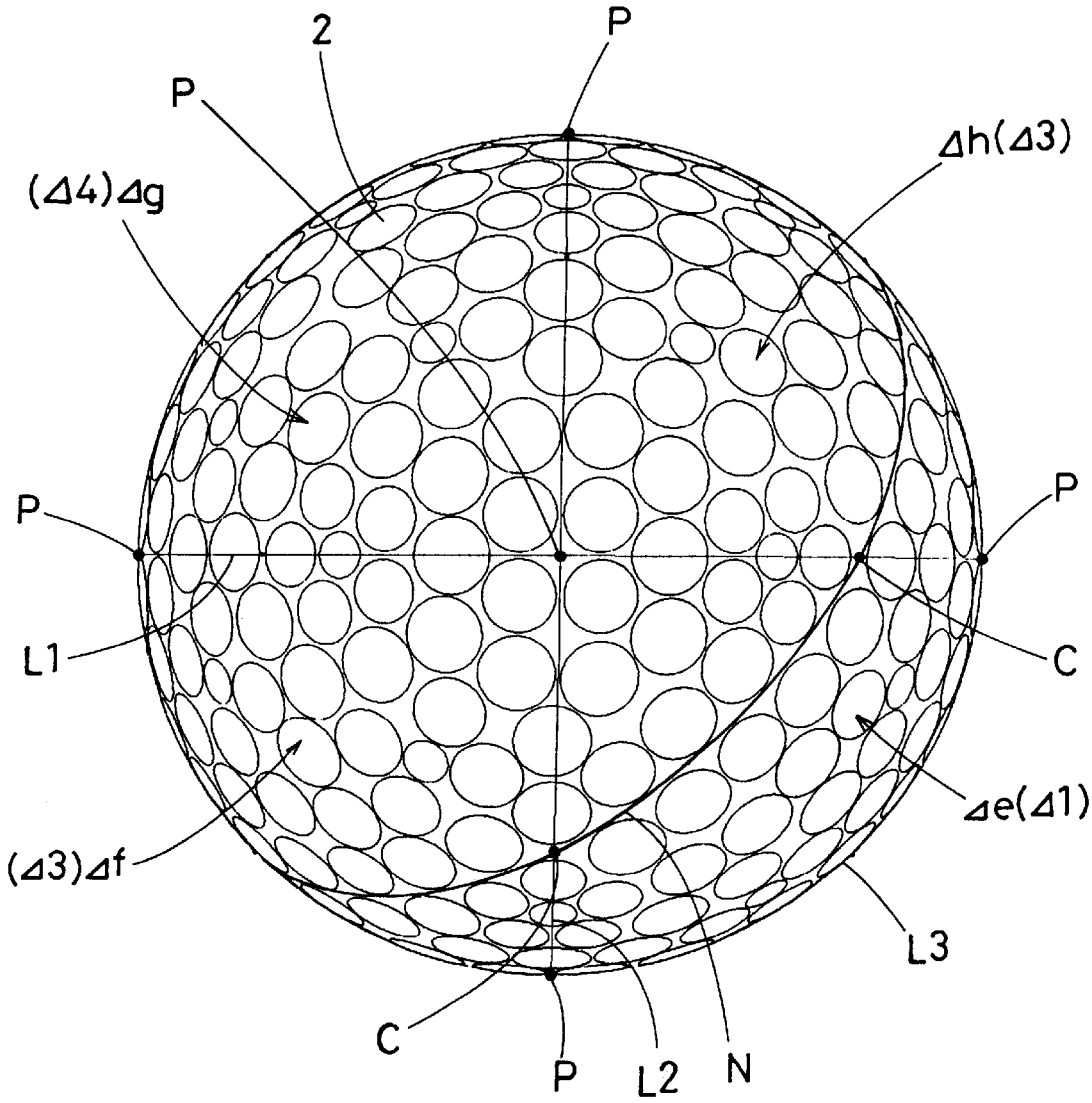
FIG. 8 is a rear view thereof.
Figure 9A:
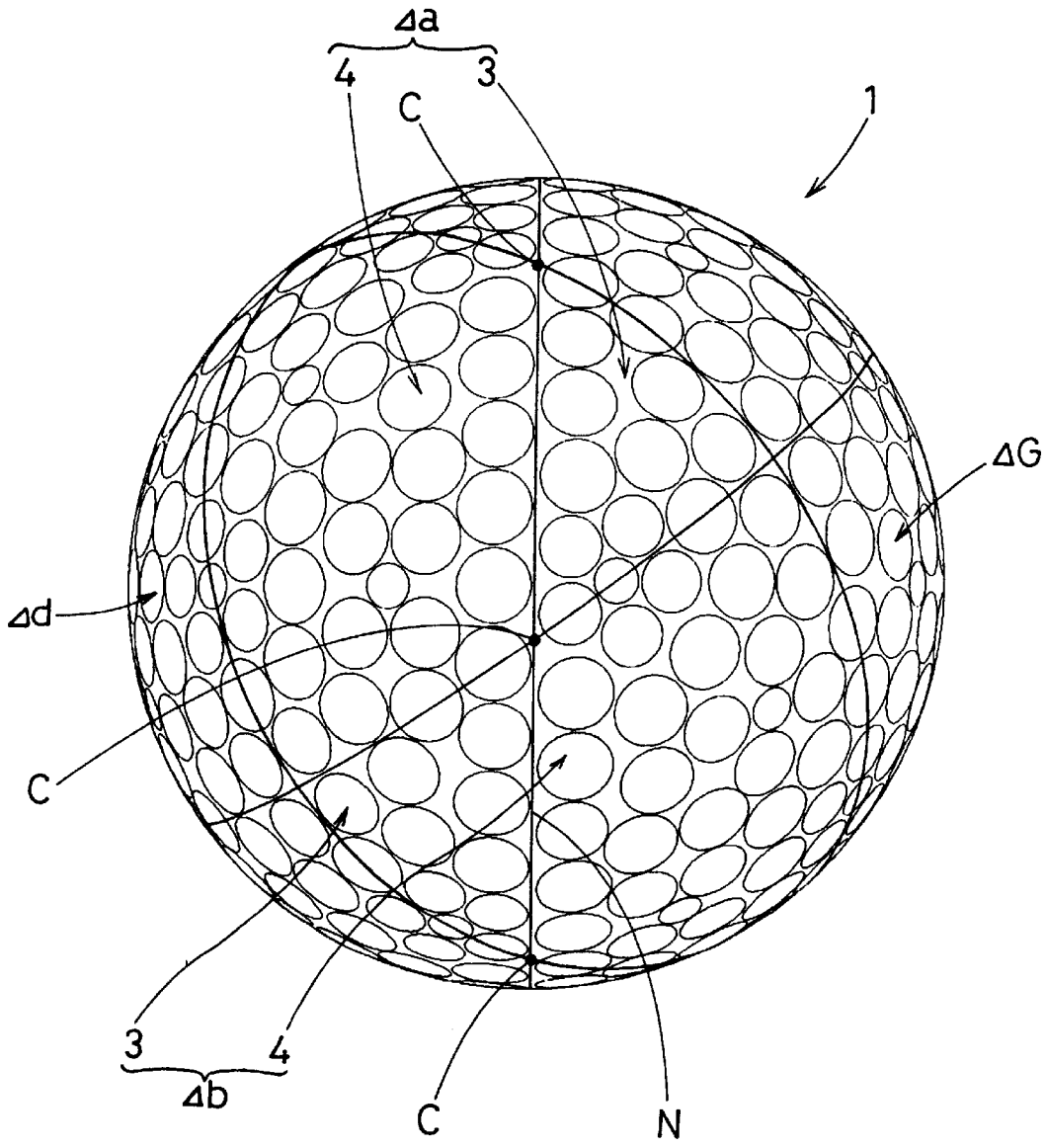
FIG. 9A is a view thereof wherein the parting line is shown as vertical.
Figure 9B:
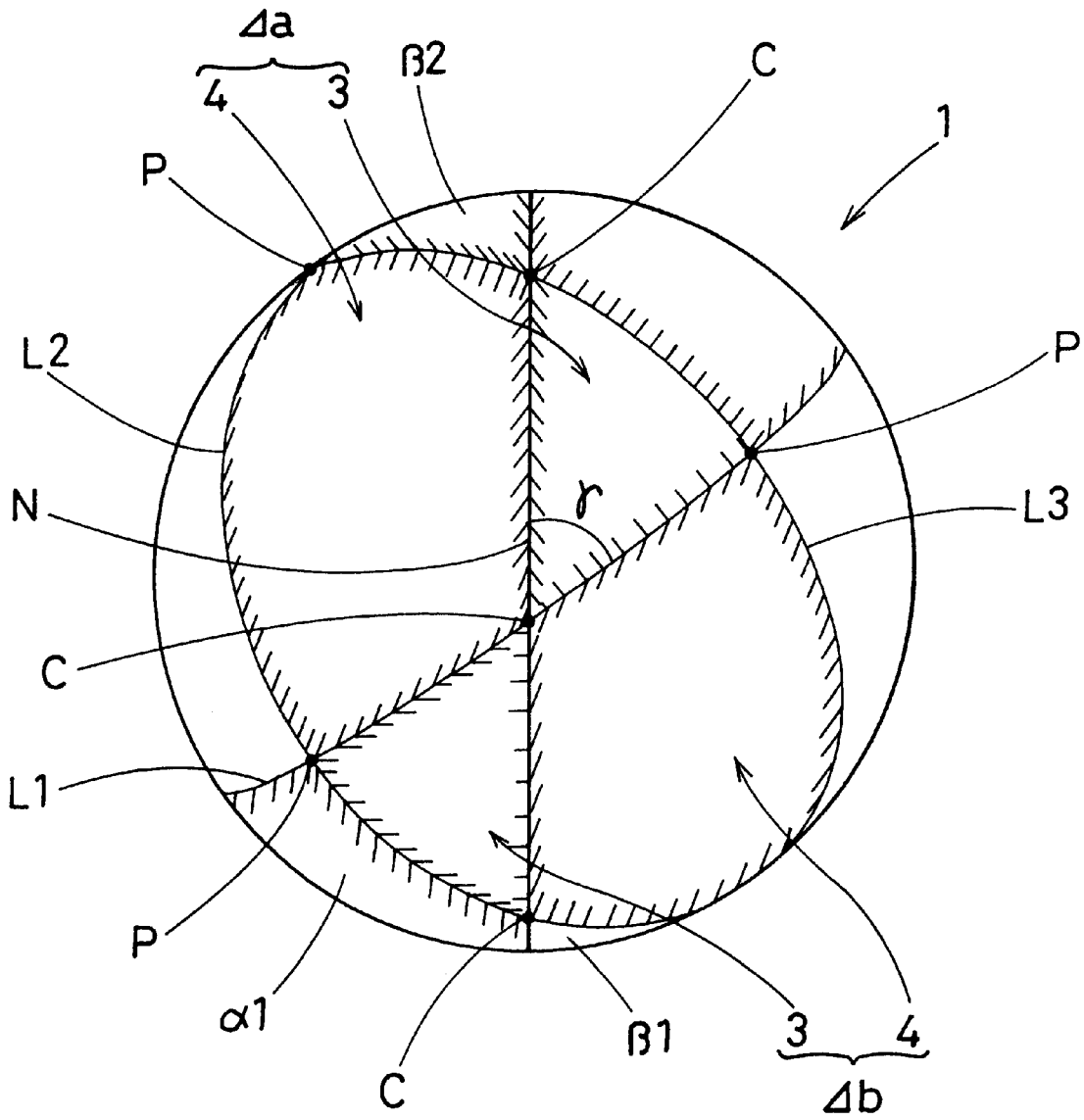
FIG. 9B is the same view as FIG. 9A but the dimples are omitted.

With respect to each of the great circles L1 to L3, the total Da of the number of dimples 2 crossed by the great circle and the number of the dimples 2 adjacent to the great circle is set to be smaller than the number Db of the dimples 2 adjacent to the parting line N. Preferably, the ratio (Da/Db) is in the range of from 0.75 to 0.95, more preferably 0.80 to 0.90. In FIG. 6, hatched are the dimples crossed by the great circle L3 and dimples adjacent to the great circle L3, and the total number Da thereof is 52. In FIG. 7, hatched are the dimples 2 adjacent to the parting line N, and the total number Db thereof is 62.

Figure 10:
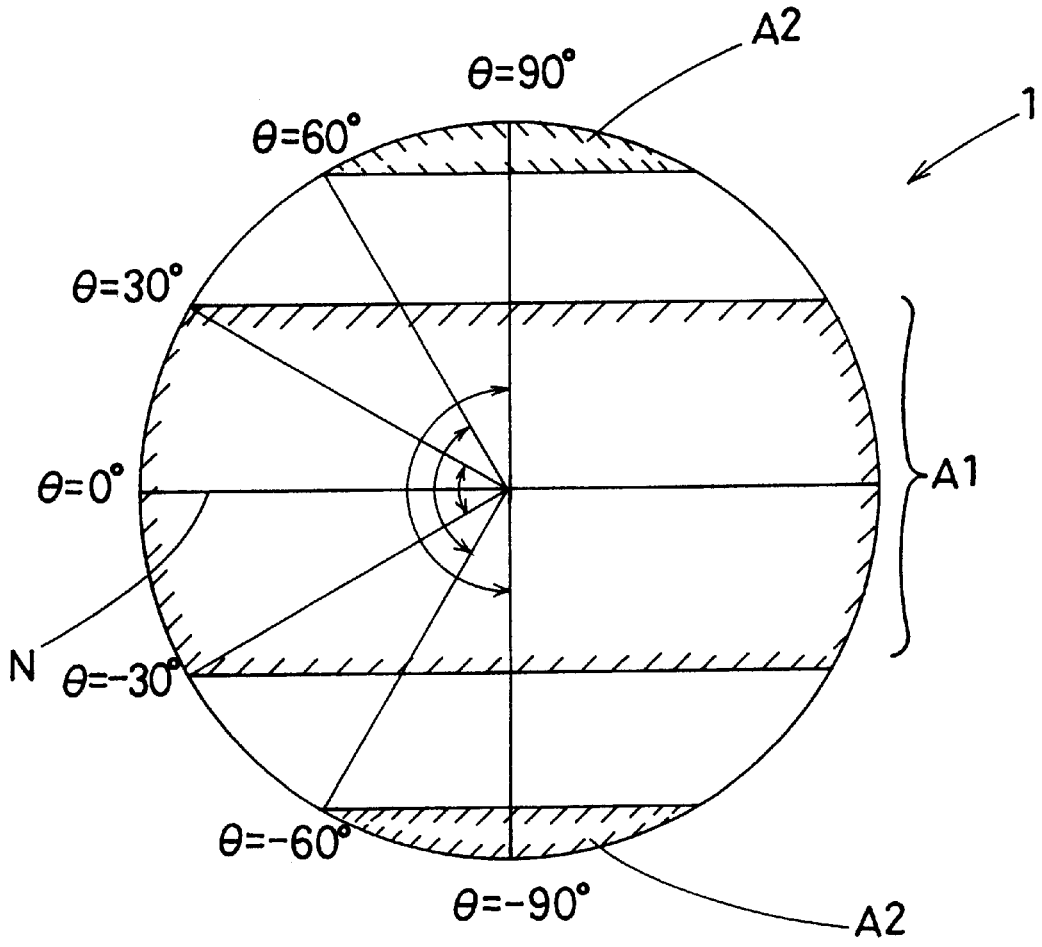
FIG. 10 is a diagram of the golf ball for explaining a zone near the parting line and far zones.

As shown in FIG. 10 in which the golf ball 1 is shown such that the parting line N is horizontal, a zone A1 near the parting line N and two zones A2 far from the parting line N are defined as follows: the near zone A1 is such that any point on the spherical surface has a central angle θ of not more than 30 degrees (as absolute value) with respect to an imaginary plane including the parting line N; and the far zone A2 is such that any point on the spherical surface has a central angle θ of from 60 to 90 degrees (as absolute value) with respect to the imaginary plane.

With respect to the dimples having the same diameter, the average volume Vs of the dimples in the near zone A1 is different from the average volume Vp of the dimples in the far zones A2. In this example, there are the first to fourth dimples 2A to 2D in each of the near zone A1 and far zones A2. As to the first dimples 2A for instance, the average dimple volume Vs1 in the near zone A1 is more than the average dimple volume Vp1 in the far zones A2. As to the second to fourth dimples 2B, 2C and 2D, the same relationship (near zone A1 >far zones A2) exists. In each kind of dimples, the average volume Vs in the near zone A1 is more than 1.04 but not more than 1.20 times, preferably 1.07 to 1.17 times the average volume Vp in the far zones A2.

The volume of the dimples is adjusted by changing the depth and/or curvature of the dimples. Thus, the dimples 2 of the same diameter are not always the same volume. Here, the volume of a dimple is defined as the volume of a space surrounded by the surface of the dimple and a flat plane contacting with the edge of the dimple and closing the dimple. The volume of the dimples 2 has an influence upon the flight characteristics of the golf ball. In general, the higher the circumferential speed, the greater the dimple effect.

As explained above, round dimples having four different diameters are used in this embodiment. However, it is possible to use dimples having the same diameter in all the spherical equilateral triangles.

Comparison Test

Figure 12:
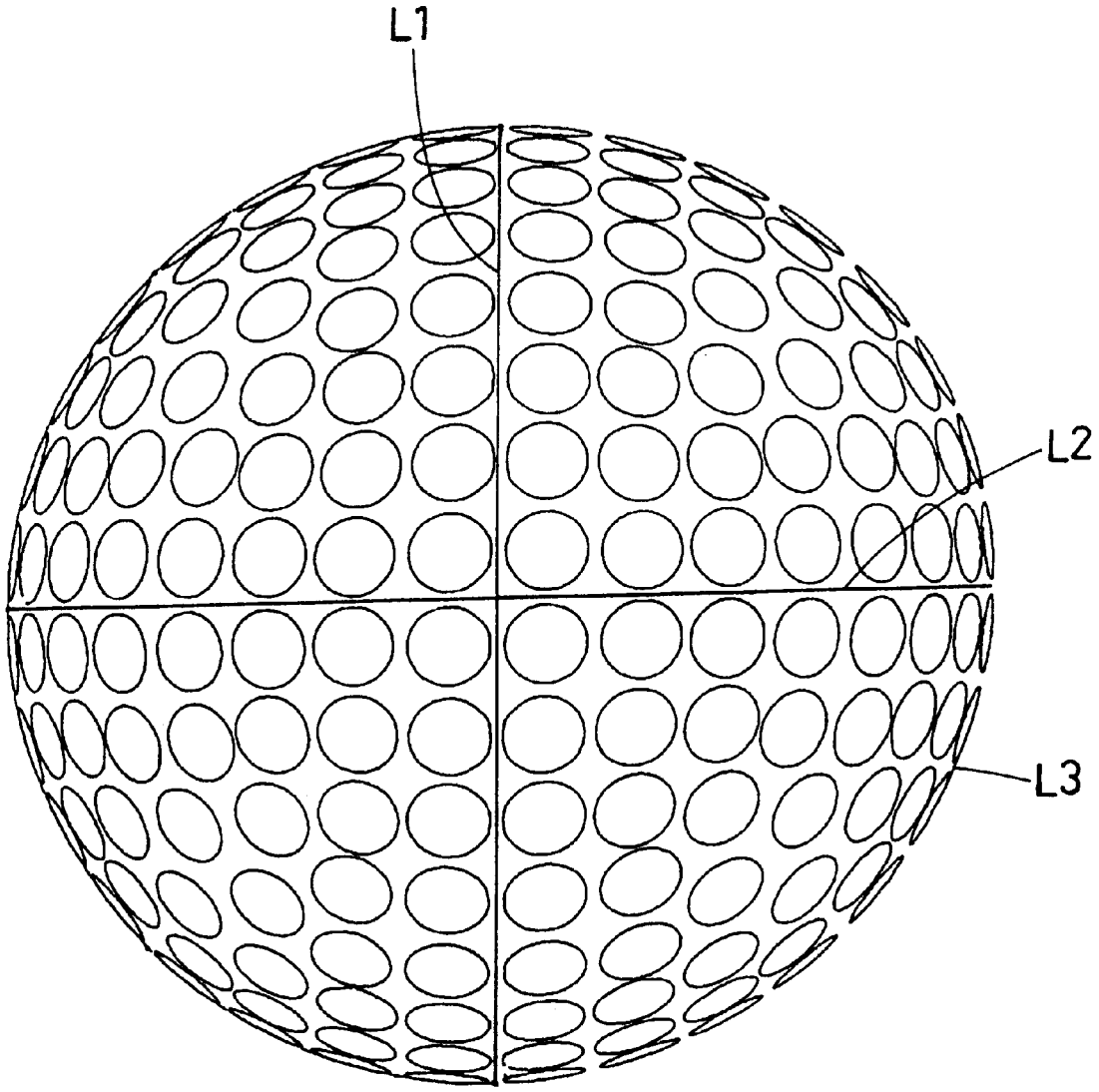
FIG. 12 is a front view of a conventional golf ball.
Figure 13:
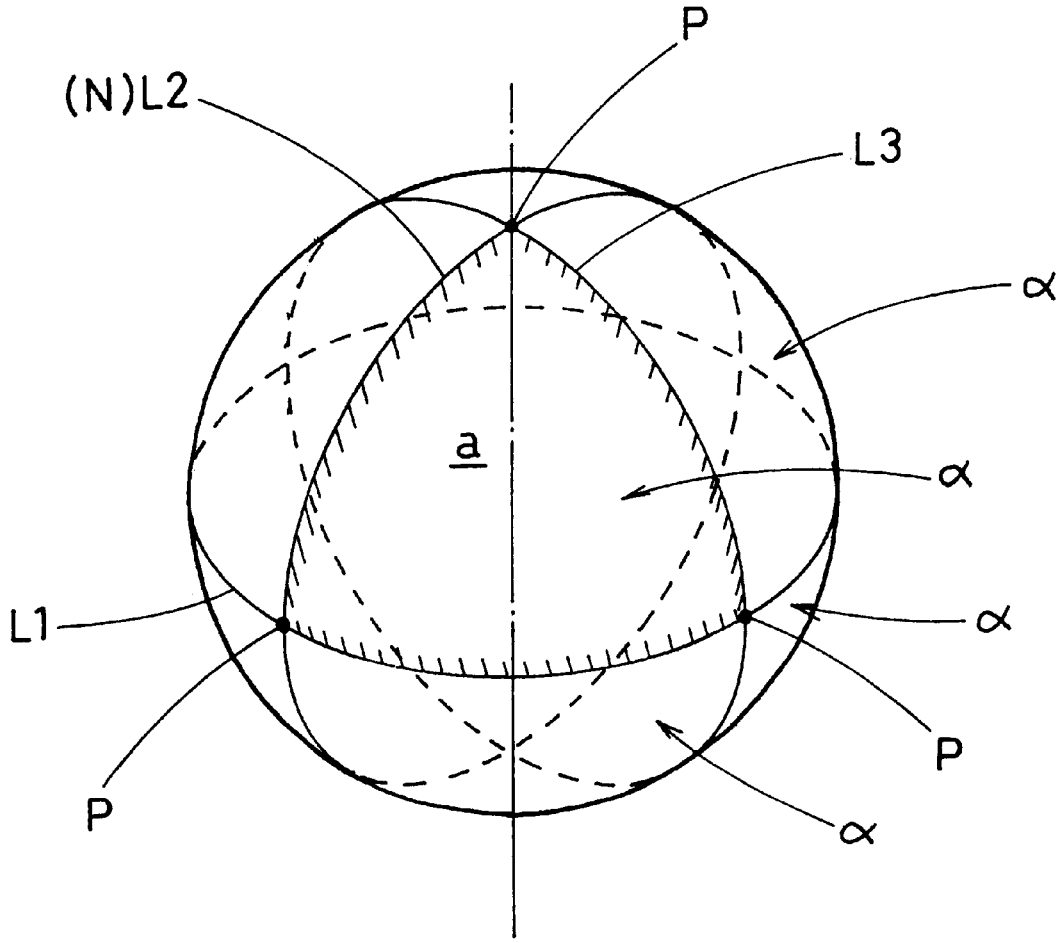
FIG. 13 is a diagrammatic perspective view for explaining a conventional regular octahedron arrangement.

A golf ball shown in FIGS. 3A–9A according to the present invention and a conventional golf ball shown in FIGS. 12 and 13 were prepared. These golf balls were the same structure except for dimples and had the same two-piece structure. The conventional golf ball had dimples in a regular octahedron arrangement wherein a parting line N extended on one (L2) of the three great circles L1–L3, and the eight spherical equilateral triangles were the same dimple pattern (alpha).

The golf balls were tested for the difference in flight characteristics between the seam-hitting and pole-hitting. As explained above, the seam-hitting is that the rotational axis of backspin is at a right angle to with respect to a plane including the parting line N as shown in FIG. 11A. The pole-hitting is that the rotational axis of backspin is parallel to a plane including the parting line N as shown in FIG. 11B. The hitting was made at a constant golf club head speed of 49 meters/second using a swing robot with which a metal-head driver (#1) was equipped.

The specifications of the golf balls and the average of carry in yard of twenty hits are shown in Table 1.

TABLE 1

| | Inventional (FIGS. 3A–9A) | | | | Conventional (FIG. 12) | | |
|---|---|---|---|---|---|---|---|
| | | | Volume ($mm^3$) | | | | Volume |
| Golf Ball | Number | Diameter (mm) | (Vs) θ ≦30 | (Vp) 60> θ ≦90 | Number | Diameter (mm) | ($mm^3$) 0≦ θ ≦90 |
| Dimples | | | | | | | |
| First dimple | 186 | 3.95 | 0.984 | 0.848 | 336 | 3.5 | 0.938 |
| Second dimple | 114 | 3.7 | 0.896 | 0.772 | — | — | — |
| Third dimple | 60 | 3.25 | 0.698 | 0.602 | — | — | — |
| Fourth dimple | 30 | 2.35 | 0.389 | 0.335 | — | — | — |
| Carry (yard) | | | | | | | |
| Pole hitting | | | 220.1 | | | 218.3 | |
| Seam hitting | | | 219.9 | | | 216.2 | |
| Difference | | | 0.2 | | | 2.1 | |

From the test results, it was confirmed that, by contrast with the conventional golf ball, in the golf ball according to the present invention, the variation of carry and the change in ballistic course could be minimized, and thus the aerodynamic symmetry was greatly improved.

What is claimed is:

1. A golf ball having a spherical surface provided with a plurality of dimples, a parting line extending on a great circle without crossing any of the dimples, and a first great circle, a second great circle and a third great circle dividing the spherical surface into eight spherical equilateral triangles, wherein said parting line crosses six of the eight spherical equilateral triangles, and with respect to each of the first to-third great circles, the number of dimples on one side of the great circle is equal to the number of dimples on the other side of the great circle.

2. The golf ball according to claim 1, wherein with respect to any of two opposite equilateral triangles which are opposed about the center point of the spherical surface, the arrangement of dimples in one of them and the arrangement of dimples in the other are point-symmetrical about the center point, with respect to any of two adjacent spherical equilateral triangles which have a side in common, the arrangement of dimples in one of them and the arrangement of dimples in the other are not line-symmetrical about the common side, and with respect to any of four adjacent spherical equilateral triangles which have an apex in common, the arrangement of dimples in the four spherical equilateral triangles is not a point-symmetry about the common apex.

3. The golf ball according to claim 2, wherein the parting line passes at the midpoint of each of two of the three sides of each of the six-spherical equilateral triangles so as to divide each of the six spherical equilateral triangles into a spherical isosceles triangle and a spherical quadrangle.

4. The golf ball according to claim 1, wherein the parting line passes at the midpoint of each of two of the three sides of each of the six spherical equilateral triangles so as to divide each of the six spherical equilateral triangles into a spherical isosceles triangle and a spherical quadrangle, with respect to any of two spherical isosceles triangles which are opposed about the center point of the spherical surface, the arrangement of dimples in one of them and the arrangement of dimples in the other are point-symmetrical about the center point, and with respect to any of two spherical quadrangles which are opposed about the center point of the spherical surface, the arrangement of dimples in one of them and the arrangement of dimples in the other are point-symmetrical about the center point.

5. The golf ball according to claim 1, wherein with respect to each of the first to third great circles, the total of the number of dimples crossed by the great circle and the number of dimples adjacent to the great circle is less than the number of dimples adjacent to said parting line.

6. The golf ball according to claim 2, wherein with respect to each of the first to third great circles, the total of the number of dimples crossed by the great circle and the number of dimples adjacent to the great circle is less than the number of dimples adjacent to said parting line.

7. The golf ball according to claim 3, wherein with respect to each of the first to third great circles, the total of the number of dimples crossed by the great circle and the number of dimples adjacent to the great circle is less than the number of dimples adjacent to said parting line.

8. The golf ball according to claim 4, wherein with respect to each of the first to third great circles, the total of the number of dimples crossed by the great circle and the number of dimples adjacent to the great circle is less than the number of dimples adjacent to said parting line.

* * * * *